United States Patent [19]

Billings

[11] Patent Number: 4,496,370

[45] Date of Patent: Jan. 29, 1985

[54] ZINC OXIDE-CHAR GASIFICATION PROCESS

[75] Inventor: William G. Billings, Bartlesville, Okla.

[73] Assignee: Phillips Petroleum Company, Bartlesville, Okla.

[21] Appl. No.: 481,956

[22] Filed: Apr. 4, 1983

[51] Int. Cl.[3] ..... C10J 3/46

[52] U.S. Cl. ..... 48/197 R; 48/209; 48/210; 252/373; 423/415 A; 423/655

[58] Field of Search ..... 48/197 R, 210, 209; 252/373; 423/415 A, 655, 656

[56] References Cited

U.S. PATENT DOCUMENTS

| | | | |
|---|---|---|---|
| 2,342,368 | 2/1944 | Queneau . | |
| 2,592,377 | 4/1952 | Barr et al. . | |
| 2,602,809 | 7/1952 | Dickinson . | |
| 3,804,606 | 4/1974 | Archer et al. . | |
| 4,070,160 | 1/1978 | Cottle . | |
| 4,073,630 | 2/1978 | DeLano | 48/197 R |
| 4,132,764 | 1/1979 | Cines et al. . | |

OTHER PUBLICATIONS

John Holmgren, "Coal Gasification Power Generation" Aware Magazine pp. 11 through 14, Jun., 1977.

Kirk-Othmer *Encyclopedia of Chemical Technology* 2nd Edition, vol. 22, p. 589.

Hammond et al., Energy and the Future (American Association for the Advancement of Science 1973) pp. 17 through 23, "Power Gas and Combined Cycles".

Wett (Editor) "Coal: Future Source of Oil and Gas", *Oil and Gas Journal* 75 (35), Petroleum/2000 (Aug. 1977) pp. 517–518.

Vogt et al., "Status of the Shell-Koppers Process" *CEP* Mar. 1980, pp. 65–72.

*Primary Examiner*—Peter Kratz

*Attorney, Agent, or Firm*—Lyell H. Carver

[57] ABSTRACT

In the gasification of char with zinc oxide, the improvement which comprises reacting the off-gas stream of gaseous zinc and carbon monoxide with steam at elevated temperatures in a second reactor means thereby oxidizing the zinc to zinc oxide and yielding a second gaseous stream containing carbon monoxide and hydrogen. This improved process avoids having to condense and revaporize the zinc, heretofore an economic barrier to the development of the zinc oxide char processes.

18 Claims, 2 Drawing Figures

ZINC OXIDE-CHAR GASIFICATION PROCESS

The invention relates to the gasification of source carbonaceous materials such as coal, char, or coke.

BACKGROUND OF THE INVENTION

In the gasification of solid carbonaceous source material such as coal, char, and coke, a metal oxide particularly such as zinc oxide, is employed to provide the necessary oxygen. Such techniques are disclosed in U.S. Pat. Nos. 2,592,377 and 2,602,809.

In these processes, a finely divided solid particle-form carbonaceous material is admixed with zinc oxide as the oxygen carrier or oxygen donor in a reaction which can be illustrated by:

$$C + ZnO \rightarrow Zn\uparrow + CO\uparrow.$$

The reactants to the left are solid materials. The products to the right are gaseous materials. Zn vapor forms in the gasification of the carbonaceous material. Heretofore, it has been necessary to cool the gaseous reaction products, subsequent to the gasification step, to separate the Zn as a molten metal, from the gaseous CO carbon monoxide, which is the desired product.

Heretofore, the condensed molten Zn has been reoxidized in an oxidation step, which converts the molten zinc back to gaseous zinc, and then reacts the gaseous zinc with air as the oxygen source to reform the zinc oxide to recycle to the gasification step for further contact with char.

As can be realized, the cooling requirements for condensation of the gaseous zinc to molten zinc for separation of the carbon monoxide product, and the heating requirements for revaporization of the molten zinc in order to reoxidize it, have been energy intensive steps and pose literal economic barriers to the development of the zinc oxide processes. Furthermore, during cooling of the zinc/carbon monoxide gas to obtain molten zinc metal, some formation of zinc oxide has been a slight but obstinate result. Apparently, some reversion to the oxide zinc occurs with consequent loss of a portion of the desired carbon monoxide, forming what sometimes has been termed a "blue powder" in zinc collection chambers, leading to line plugging and other difficulties.

Needed has been a straight-forward method of reoxidation of the zinc to zinc oxide, with minimization of energy requirements.

BRIEF DESCRIPTION OF THE INVENTION

I have discovered in the zinc oxide/char gasification process wherein zinc oxide and a carbon source are contacted in a reactor at elevated temperatures to produce a gaseous product stream of zinc vapor and carbon monoxide, surprisingly that I can react this stream as gases with steam at elevated temperatures in a second reactor means to yield a final gaseous product containing carbon monoxide, hydrogen, methane, water, and carbon dioxide, and importantly reoxidized zinc oxide.

I have obviated the prior art teachings of having to condense and revaporize zinc, heretofore an economical barrier to the development of the zinc oxide processes. Furthermore, I avoid the cooling steps and condensation steps for zinc metal which have been so attendant with the troublesome "blue powder" formation.

According to the process of my invention, I take the off-gas stream from the zinc-char gasification stage and react it directly at elevated temperatures with steam, thereby oxidizing the zinc to zinc oxide for recycle to the gasification step, and producing off-gases suitable for use as a medium Btu gas stream. Alternatively, the gas stream from the steam-oxidation step can be further separated to recover desirable components thereof.

In one mode of my invention, the off-gas stream from the steam-oxidation step, which, of course, is at elevated temperatures, can be passed in indirect heat exchange, through a waste heat boiler to produce steam for plant use such as in the steam-oxidation zone, and the gases then taken to fuel usage, or to gas separation as above described, or in part to each. In another option, the gases from the steam-oxidation step can be utilized in part in a auxiliary steam boiler as fuel to produce steam for plant use such as in the steam-oxidation zone, and the remainder then taken for separation. In a further mode, the gas stream from the steam-oxidation step can be subjected to separation, water and carbon dioxide removed therefrom, and a portion of the resultant Btu-improved stream now comprising $H_2/CO/CH_4$ can be used for its constituent products and/or in part used to fuel an auxiliary steam boiler for production of steam for plant and/or steam-oxidation zone requirements.

Figure 1:
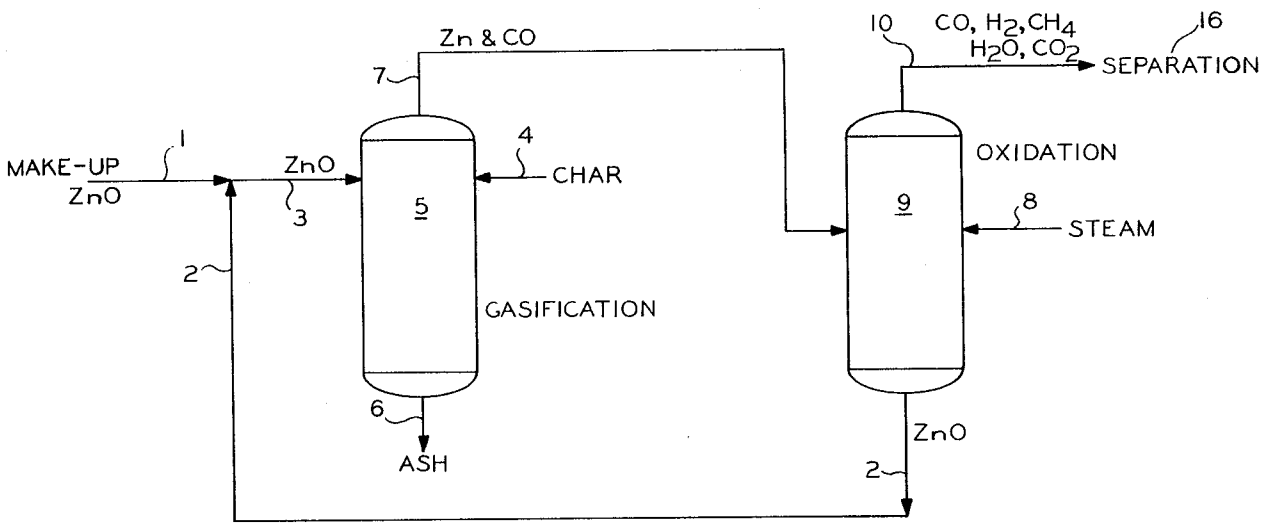
FIG. 1 shows makeup zinc oxide 1 together with recycle zinc oxide 2 forming a zinc oxide stream 3 which is fed together with char 4 to gasification zone 5. In gasification zone 5 the char and zinc oxide are reacted, residue removed as ash 6, and the gaseous stream 7 of zinc metal vapor and carbon monoxide is removed overhead. In accordance with my invention, the gaseous stream 7 is reacted with steam 8 in oxidation zone 9, converting the zinc to zinc oxide 2 for recycle. The off-gases 10 comprising predominantly carbon monoxide and hydrogen, with lesser amounts of methane, water, and carbon dioxide, are taken to separation 16.
Figure 2:
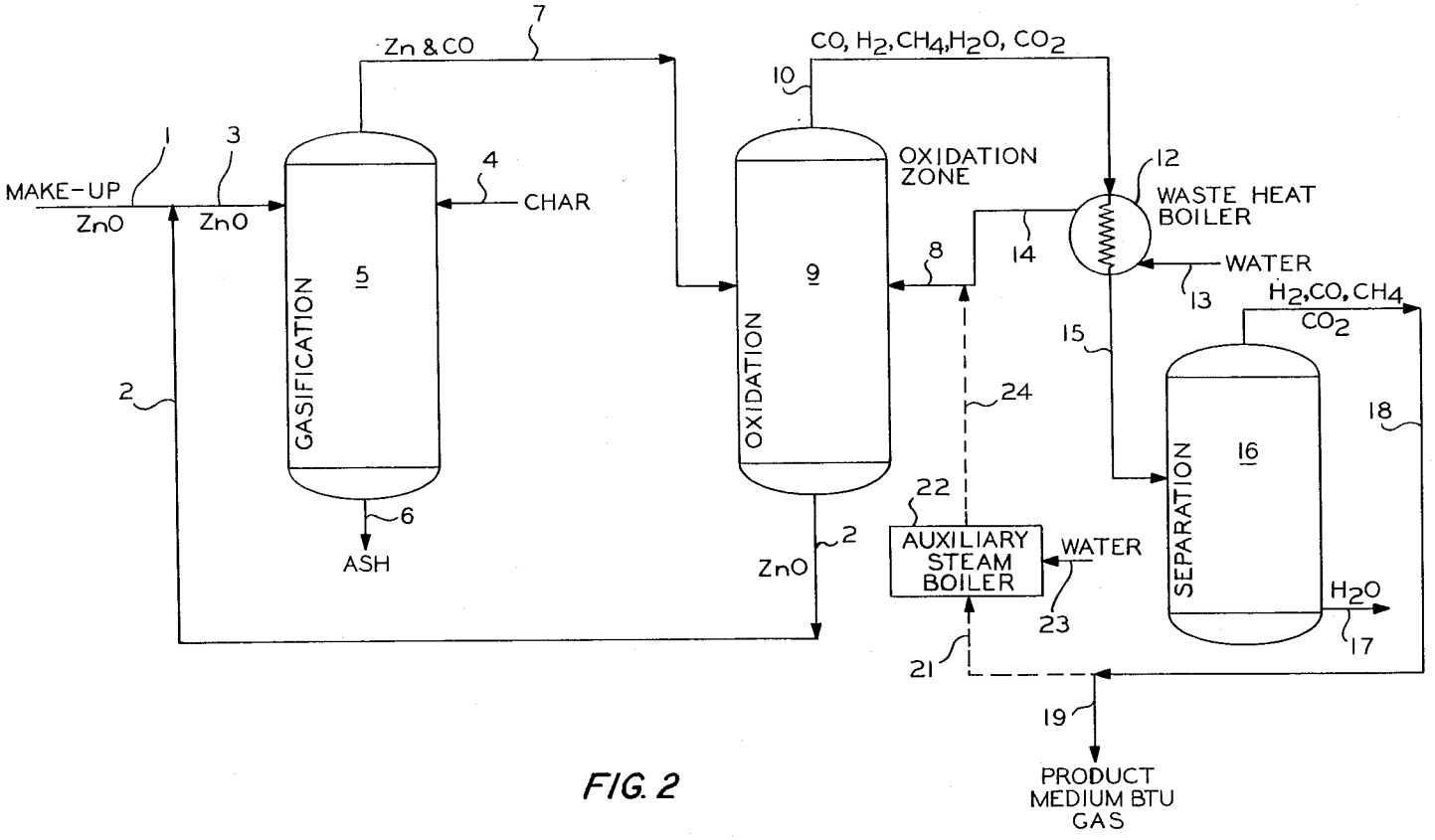
FIG. 2 illustrates further steps in accordance with some of the options of my process as described hereinabove. The steam-oxidation step off-gas stream 10, comprising carbon monoxide/hydrogen/methane/water/-carbon dioxide, is passed through waste heat boiler 12 in indirect heat exchange with water 13. The water 13 is converted to steam 14 which can be utilized 8 in steam-oxidation zone 9. The now relatively cooled gaseous stream 15 can be taken to separation 16. Water is removed 17. The slight content of carbon dioxide also can be removed (not shown) if desired. The remainder of the stream, now comprising hydrogen/carbon monoxide/methane/optionally traces of carbon dioxide, is taken 18, 19 as product of medium Btu gas. However, if desired, the minor content of carbon dioxide need not be removed but can be retained in the off-gas stream 10 since the amounts are not sufficient to normally require separation, detracting only slightly from the Btu value of the product gas stream 19. If desired, a portion 21 of the product gas stream 18 or 19 can be taken as fuel to an auxiliary steam boiler 22 wherein water 23 is converted to further steam 24.

In an option not shown on the drawings, the gas separation step 16 can be omitted, and the gaseous stream 15 itself can be taken in part to auxiliary steam boiler 22 as fuel thereto. In another mode, the waste heat boiler 12 and separation 16 are at least in part bypassed and the steam-oxidative step 9 off-gases 10 are employed at least in part directly as fuel in auxiliary boiler 22.

DETAILED DESCRIPTION OF THE INVENTION

The solid carbon or carbonaceous sources employed in my process are those carbonaceous materials characterized as solid at temperatures of about 20° C. Non-limiting examples of suitable carbon sources include coal, coke, char, tar sand, peat, oil shale, lignite, rubber scrap, and so forth. Particularly well suited are those solid carbon-containing sources that are solid at temperatures even up to such as 2500° F. (1373° C.).

The process of my invention is effective to gasify and convert to valuable fuel gas, primarily carbon monoxide, solid carbon sources or solid residues from other gasification or liquefaction processes such as those resulting from treating coal, oil shale, and residual oils. Solid char residues are produced, for example, by coal pyrolysis processes of various types.

A feed comprising finely divided particulate carbon or carbon-containing material is admixed with finely divided particulate zinc oxide. The size of the carbon-containing particles employed can vary over a wide range, certainly smaller particles being preferred, preferably no more than about 0.4 mm in diameter, with a preferred range of about 0.04 to 0.4 mm. Substantially all of the particles should be of size as to pass through a standard U.S. 20 sieve.

The gasification reaction 5 can be carried out using suitable techniques known in the art for this aspect of the process. Basically, the gasification step comprises contacting the carbon-containing particles with the particulate zinc oxide at temperatures effective for oxidizing the carbon primarily completely to carbon monoxide, with accompanying reduction of the zinc oxide to zinc which at the temperatures of reaction will be in the gaseous form. Usually some traces of carbon dioxide accompany the carbon monoxide production. The gasification reaction temperatures generally are in the range of about 1700° F. to 2800° F. (930° C. to 1540° C.), presently preferably about 1800° F. to 2200° F. (980° C. to 1200° C.). Heat can be supplied such as by indirect heat exchange with hot off-gases from the steam-oxidation zone, or by indirect heat exchange of gases from combustion of a portion of char in a separate char/air combustion means.

Although the zinc oxide/char reactions involved can be considered as solid/solid reactions, the pressures employed can vary over a wide range. Satisfactory operating pressures employed can be in the range of about atmospheric to upwardly to such as about 650 psig. Presently preferred and convenient is a pressure slightly above atmospheric pressure, such as about 0.1 to 50 psig (102–446 kPa).

Although various means of contacting such as fixed beds can be employed, most convenient and presently preferred method is to mix particles of carbon source material and zinc oxide together in a fluidized bed gasifier.

From the zinc-char gasification step 5, the off-gases, comprising zinc vapor and carbon monoxide, and some traces such as about 0.1 to 5 mol percent carbon dioxide, are taken to my steam-oxidation step 9.

In accordance with my discovery, zinc in the vapor state can be oxidized with steam even in the presence of the carbon monoxide. Granted, that two competing reactions are involved:

$$Zn + H_2O \rightarrow ZnO + H_2 \quad (A)$$

$$CO + H_2O \rightleftharpoons CO_2 + H_2 \quad (B)$$

I have discovered that zinc in the vapor state can be oxidized with steam at a rate much faster than the oxidation of carbon monoxide. Reaction (A) is much faster than Reaction B. The result is that the gaseous zinc becomes solid zinc oxide which is easily separated, without appreciable loss of CO to $CO_2$. The product gas 10 is largely hydrogen and carbon monoxide, with traces of methane, water, and carbon dioxide.

The data summarized below in Table I illustrate that vapor zinc is oxidized to zinc oxide while only a small amount of the CO is oxidized to $CO_2$. The percent conversion of Zn to ZnO was calculated at 100 percent based on the amount of hydrogen recovered minus the amount of hydrogen that would have resulted from the second of the above reactions. No free zinc was observed upon teardown of the reactors.

TABLE I

REACTION OF ZINC VAPOR, CARBON MONOXIDE, AND STEAM

| Run No. | 1 | 2 | 3 |
|---|---|---|---|
| Mols Zn fed per hour | 0.129 | 0.078 | 0.049 |
| Mol Ratio CO/Zn | 1.8 | 2.9 | 4.5 |
| Mol Ratio Steam/Zn | 5.1 | 8.5 | 15.5 |
| Reaction Temperature, °C. | 1165 | 811 | 1100 |
| Product 10 Gas Analysis: | | | |
| %[a] $H_2$ | 97.8 | 15.5 | 37.4 |
| % CO | 1.4 | 82.8 | 47.8 |
| % $CO_2$ | 0.8 | 1.8 | 14.8 |
| Percent Zn → ZnO | 100 | 100 | 100 |

[a]mol percent.

Also present in the gas stream were traces of methane, but not sufficient to enter into the above calculations. It is noted that the product gas stream 10 composition is highly dependent upon the temperature employed as well as, apparently, on the mol ratio steam:zinc. Where the mol ratio of steam:zinc was held down, complete oxidation of zinc to zinc oxide was obtained, with really quite minimal formation of carbon dioxide. These data show that gaseous zinc can be oxidized to ZnO with steam without oxidizing enough carbon monoxide to carbon dioxide to make the process unattractive.

In the above runs, carbon monoxide was bubbled through molten zinc heated to a temperature selected to give a desired partial pressure of zinc. A resulting gaseous mixture of gaseous zinc and carbon monoxide was preheated to the desired reaction temperature where it entered a reaction (oxidation) zone to be reacted with a measured amount of preheated steam. The gas mixture from the oxidation step was cooled, water vapor collected in anhydrous calcium sulfate (Drierite), and remaining volume measured by a dry test meter, with composition determined by Carle gas liquid chromatography (glc). The temperature of the liquid zinc was monitored throughout the reaction and the feed rate of zinc calculated from its partial pressure. Carbon monoxide feed rate was calibrated prior to the run via a rotameter and dry test meter. A precise steam rate was obtained by passing available house steam to a line fitted with a steam trap and an 0.004 inch jeweled orifice at a set temperature and pressure combination, predetermined to give the desired flow rate.

In accordance with my discovery, less carbon dioxide is produced than thermodynamic equilibrium theory might otherwise predict perhaps because steam oxidizes zinc vapor faster than it oxidizes carbon monoxide.

TABLE II

COMPARISON OF THEORETICAL EQUILIBRIUM VS MEASURED GAS PHASE COMPOSITION AT REACTION CONDITIONS AT ONE ATMOSPHERE

| Run No. | | 1 | 2 | 3 |
|---|---|---|---|---|
| Temperature, °C. | | 1165 | 811 | 1100 |
| Feed Ratios (mol ratios): $Zn_v/CO/H_2O$[a] | | 1:1.8:5.1 | 1:2.9:8.5 | 1:4.5:15.5 |
| Theoretical Thermodynamic Equilibrium[b] | | | | |
| Mol Percents: | $H_2$ | 49.4 | 50.3 | 45.4 |
| | CO | 29.3 | 16.6 | 21.4 |
| | $CO_2$ | 21.3 | 33.1 | 33.3 |
| Measured Gas Phase Composition | | | | |
| Percent | $H_2$ | 97.8 | 15.5 | 37.4 |
| | CO | 1.4 | 82.8 | 47.8 |
| | $CO_2$ | 0.8 | 1.8 | 14.8 |

[a] $Zn_v$ indicates zinc vapor.
[b] As calculated from University of Tulsa Thermodynamic Equilibrium program.

Of course, a disadvantage of my process is that the steam oxidation of zinc is less exothermic than air oxidation by, according to my calculations, roughly about 35 percent. Nevertheless, my process is much more efficient than prior art processes, by not having to firstly cool and condense the zinc vapor to molten zinc for separation, and then reheat and revaporize for oxidation with air. By my process, the costly and technically troublesome step of cooling the gasification stream is eliminated, and since in accordance with my process zinc oxide is produced by steam oxidation, the energy intensive step of vaporizing the liquid zinc to gas also is eliminated. Also, by my process, hydrogen can be produced as a major product or can be produced in combination with carbon monoxide, by simple adjustment of CO:Zn ratios and/or by adjustment of steam-oxidation temperatures.

In accordance with my process, the oxidation step should be conducted under the following conditions:

| | Broad | Preferred |
|---|---|---|
| Temperature: | 700° C. to 1300° C. | 800° C. to 1200° C. |
| Pressure: | 0.1 to 50 psig | 0.1 to 2 psig |
| Mol ratio Steam to Zinc: | 0.1 to 20 | 1 to 10 |

Expected composition of the off-gas from the steam-oxidation step will vary somewhat as can be seen from the above data. The amount of water to be expected will be in the range of about 5 to 80 mol percent. The amount of methane can be in the range of about 0 to 15 mol percent. The mol ratio of hydrogen:carbon monoxide can vary considerably, such as about 1:99 to 99:1 as may be desired. The ratio can be varied, as shown by the data in Tables I and II, by varying the Zn:steam ratios and the steam oxidation reaction temperature.

In accordance with one aspect of my invention, the hot off-gases from the steam-oxidation zone, at a temperature in the range of about 1000° C. to 1500° C., can be taken via indirect heat exchange through a waste heat boiler where water can be converted to further steam. Such steam, if not at sufficient temperature to utilize efficiently in the steam-oxidation zone can be utilized elsewhere in the plant, or can be further heated by known means.

The now somewhat cooled off-gases 15 can be taken to gas separation 16 such as carbon dioxide removal by absorption in a circulating amine or hot potassium carbonate solution. Hydrogen can be recovered using common processing methods such as the cryogenic hydrogen upgrader or Prism ® hydrogen separation systems.

In an alternative utilization of the hot off-gases 10 from the oxidation zone, these may be burned with the resulting combustion gases driving a combined-cycle (gas/stream) electrical power system, such as described in Holmgren "Coal Gasification Power Generation", *AWARE* pp 11–14 (June, 1977); and Hammond et al, *Energy and the Future* pp 17–23 (AAAS, 1973).

In accordance with one aspect of my invention, the gases, stripped of water, and if desired, stripped of carbon dioxide, can be taken as a stream of hydrogen/carbon monoxide/methane as product medium Btu gas. Or, the stream itself can be so utilized since the small amount of carbon dioxide therein is not objectionable for most purposes. A portion of the stream can be utilized for firing an auxiliary steam boiler to provide further steam for use in the oxidation zone.

The disclosure, including data, has illustrated the value and effectiveness of my invention. The examples, the knowledge and background of the field of the invention and the general principles of chemistry and of other applicable sciences have formed the bases from which the broad descriptions of my invention including the ranges of conditions and the generic groups of operant components have been developed, and formed the bases for my claims here appended.

I claim:

1. A process for the gasification of solid carbon-containing materials which comprises:

(a) heating under reaction conditions said carbon-containing material as finely divided carbon-containing particles with finely divided particulate zinc oxide, thereby producing a first hot gaseous stream comprising zinc vapor, carbon monoxide, and traces of carbon dioxide, (b) contacting said first hot gaseous stream with a first steam in a separate zone in the absence of solid carbon containing material at a temperature in the range of about 700° C. to 1300° C., thereby converting said zinc to solid zinc oxide, and producing a second hot gas stream comprising carbon monoxide, hydrogen, methane, water, and carbon dioxide, separating said solid zinc oxide from the second hot gas stream, and (c) recycling said zinc oxide to said step (a).

2. The process according to claim 1 wherein said carbon-containing material is provided by one or more of coal, coke, char, tar sand, peat, oil shale, lignite, and rubber scrap.

3. The process according to claim 1 wherein said finely divided carbon-containing particles are up to about 0.4 mm in diameter.

4. The process according to claim 3 wherein said step (a) employs a temperature of about 980° C. to 1200° C. at a pressure of about 0.1 to 50 psig.

5. The process according to claim 4 wherein further (d) employing said second hot gas stream at least in part in indirect heat exchange means with water to produce a second steam therefrom, and thereby cooling said second gas stream to produce a cooled gas stream.

6. The process of claim 5 wherein further employing said second steam at least in part in said step (b) as at least a part of said first steam.

7. The process according to claim 5 wherein further
(e) employing said now-cooled second gas stream at least in part as fuel in an auxiliary steam means wherein water is converted to a third steam, and
(f) employing said third steam at least in part in said step (b) as at least a part of said first steam therein.

8. The process of claim 5 further comprising separating at least in part said now partially cooled second gas stream to remove water therefrom, and optionally $CO_2$; and wherein the remaining stream comprising $H_2/Co/CH_4$ is taken as a medium Btu gas product.

9. The process of claim 1 wherein further employing said second hot gaseous stream at least in part as fuel in an auxiliary steam means wherein water is converted to further steam and used at least in part in said step (b) as at least a part of said steam therein.

10. The process of claim 1 further comprising separating hydrogen from said second gas stream.

11. The process of claim 1 wherein said (b) steam-contacting step employs a pressure of about 0.1 to 50 psig, and a steam:zinc mol ratio of about 0.1 to 20.

12. The process of claim 11 wherein said (b) steam-contacting step employs a temperature in the range of about 800° C. to 1200° C., a pressure of about 0.1 to 2 psig, and a steam:zinc mol ratio of about 1 to 10.

13. The process of claim 11 wherein in said second gas stream the ratio of $CO:H_2$ therein is controlled by the temperature of said steam-contacting step (b), and varies with the ratio of CO:Zn employed therein.

14. A process for the gasification of solid carbon-containing materials which comprises:
(a) heating under reaction conditions said carbon-containing material as finely divided carbon-containing particles with finely divided particulate zinc oxide, thereby producing a first hot gaseous stream comprising zinc vapor, carbon monoxide, and traces of carbon dioxide,
(b) contacting said first hot gaseous stream with a first steam in a separate zone in the absence of solid carbon-containing material at a temperature of about 700° C. to 1300° C., thereby converting said zinc to solid zinc oxide, and producing a second hot gaseous stream comprising carbon monoxide, hydrogen, methane, water, and carbon dioxide, separating said solid zinc oxide from the second hot gas stream,
(c) recycling said zinc oxide from said step (b) to said step (a),
(d) employing at least a portion of said second hot gas stream in indirect heat exchange with water to produce a second steam therefrom, and thereby cooling said second gas stream to produce a cooled gas stream,
(e) employing said second steam at least in part in said step (b) as at least a part of said first steam therein,
(f) employing said cooled second gas stream at least in part as fuel in an auxiliary steam-forming means wherein water is converted to a third steam,
(g) employing said third steam at least in part in said step (b) as at least a part of said first steam therein,
(h) separating a further portion of said cooled second gas stream to remove water therefrom, optionally $CO_2$ therefrom, leaving a remaining stream comprising hydrogen, carbon monoxide, and methane,
(i) employing said second hot gaseous stream at least in part as fuel in the auxiliary steam-forming means wherein water is converted to further steam,
(j) employing said further steam at least in part in said step (b) as at least a part of said first steam therein, and
(k) separating hydrogen from the remaining portion of said cooled second gas stream as a further product stream.

15. The process of claim 14 wherein said step (a) employs a temperature of about 980° C. to 1200° C. and a pressure of about 0.1 to 50 psig, and
wherein said (b) steam-contacting step employs a pressure of about 0.1 to 50 psig, and a steam:zinc mol ratio of about 0.1 to 20.

16. The process of claim 15 wherein said carbon-containing particles are provided by one or more of coal, coke, char, tar sand, peat, oil shale, lignite, and rubber scrap, and
wherein said carbon-containing particles have a particle size diameter of up to about 0.4 mm.

17. A process for controlling the ratio of $CO:H_2$ in a produced gas stream which comprises the steps:
(a) heating under reaction conditions a carbon-containing material as finely divided carbon-containing particles with finely divided particulate zinc oxide, employing a temperature of about 980° C. to 1200° C. at a pressure of about 0.1 to 50 psig, thereby producing a first hot gaseous stream comprising zinc vapor, carbon monoxide, and traces of carbon dioxide,
(b) contacting said first hot gaseous stream with a first steam in a separate zone in the absence of solid carbon-containing material at a temperature of about 700° C. to 1300° C., a pressure of about 0.1 to 50 psig, and a steam:zinc mol ratio of about 0.1 to 20, thereby converting said zinc to solid zinc oxide, and producing a second hot gas stream comprising carbon monoxide, hydrogen, methane, water, and carbon dioxide, wherein proportion of hydrogen varies with the steam:Zn ratio, and the contacting temperature employed, separating said solid zinc oxide from the second hot gas stream,
(c) recycling said zinc oxide to said step (a),
(d) employing said second hot gas stream at least in part in indirect heat exchange with water to produce a second steam therefrom, thereby cooling said second gas stream to produce a cooled gas stream,
(e) employing said second steam from said step (e) at least in part in said step (b) as at least a part of said first steam therein,
(f) employing said now-cooled second gas stream at least in part as fuel in an auxiliary steam-forming means to convert water to a third steam,
(g) employing said third steam at least in part in said step (b) as at least a part of said first steam therein,
(h) separating said now partially cooled second gas stream to remove water therefrom, optionally $CO_2$ therefrom, leaving a remaining stream comprising hydrogen, carbon monoxide, and methane,
(i) employing said second hot gaseous stream at least in part as fuel in the auxiliary steam boiler means wherein water is converted to further steam,
(j) employing said further steam at least in part in said step (b) as at least a part of said first steam therein, and
(k) separating hydrogen from said cooled second gas stream as a further product stream.

18. The process of claim 17 wherein said carbon-containing material is at least one of coal, coke, char, tar sand, peat, oil shale, lignite, and rubber scrap; and
wherein said finely divided carbon-containing particles have a diameter of up to about 0.4 mm.

* * * * *